United States Patent [19]

Wetzel

[11] 4,107,896

[45] Aug. 22, 1978

[54] SHINGLE-TYPE WALL PANEL

[76] Inventor: Alfred Wetzel, Weissdornweg 114, 5300 Bonn Bad Godesberg, Fed. Rep. of Germany

[21] Appl. No.: 836,070

[22] Filed: Sep. 23, 1977

[30] Foreign Application Priority Data

Sep. 24, 1976 [DE] Fed. Rep. of Germany ..... 2642999

[51] Int. Cl.[2] ..... E04D 1/00

[52] U.S. Cl. ..... 52/537; 52/316; 52/534; 52/553; 52/558; 52/630

[58] Field of Search ..... 52/557, 316, 558, 559, 52/553, 314, 630, 478, 521, 537, 533, 534, 519, 522, 535, 554

[56] References Cited

U.S. PATENT DOCUMENTS

| | | | |
|---|---|---|---|
| 111,307 | 1/1871 | Bliss | 52/554 |
| 256,083 | 4/1882 | Walter | 52/534 X |
| 307,590 | 11/1884 | Regan | 52/537 X |
| 370,317 | 9/1887 | Cortright et al. | 52/553 X |
| 1,041,924 | 10/1912 | Weirich | 52/537 |
| 1,125,414 | 1/1915 | Vogan | 52/522 |
| 1,226,564 | 5/1917 | Miller | 52/537 X |
| 1,963,890 | 6/1934 | Fleury | 52/630 |

FOREIGN PATENT DOCUMENTS

| | | | |
|---|---|---|---|
| 2,302,094 | 7/1974 | Fed. Rep. of Germany | 52/558 |
| 1,924,862 | 4/1978 | Fed. Rep. of Germany | 52/630 |
| 8,808 of | 1888 | United Kingdom | 52/522 |
| 1,251,269 | 10/1971 | United Kingdom | 52/533 |

*Primary Examiner*—Leslie Braun
*Attorney, Agent, or Firm*—Michael J. Striker

[57] ABSTRACT

A panel made of sheet metal, synthetic resin, or the like and adapted to be mounted shingle-fashion with a plurality of other such panels to an upright wall is of generally rectangular shape with upper and lower end edges and lateral side edges. Between these edges the panel has when mounted a horizontal bend subdividing it into an upper half and a lower half. In the upper half the panel has an upper central substantially planar region which is surrounded by an upper downwardly U-shaped non-planar attachment portion by means of which the entire panel is secured to the upright wall. The lower half has a lower central substantially planar region which is contiguous at the bend with the upper planar region and generally coplanar therewith in a relaxed unmounted condition of the panel. A lower upwardly U-shaped contoured non-planar portion has an inner periphery connected directly to the lower planar region so as to surround the same and an outer periphery which is connected directly to a lower outwardly directed flange at the edges of the lower half. When mounted the flange is generally coplanar with the upper planar region and the entire outer face of the lower half is exposed, with each side of the lower half overlying a corresponding side of an upper half of an underlying panel and the lower end edge of the panel overlying the upper end edge of an underlying panel.

10 Claims, 6 Drawing Figures

SHINGLE-TYPE WALL PANEL

BACKGROUND OF THE INVENTION

The present invention relates to a construction element. More particularly this invention concerns a shingle-type panel intended to be applied to an upright wall with a plurality of other such panels in vertically and horizontally overlapping fashion.

A standard shingle typically has a vertical length which is at least three times as long as the vertical length of the region of the shingle left exposed. Such a shingle is nailed at its upper attachment portion that is covered by overlying shingles to the wall or roof it is to cover. Vertically overlapping rows of horizontally staggered shingles therefore can very effectively protect the underlying surface from the element.

It is known to make such shingles of at least limitedly elastically deformable material and to give them in unstressed and unmounted condition a non-planar shape so that when the upper attachment portion is secured to the wall to be covered the lower half is elastically pressed firmly against the upper portions of the underlying shingles or panels. As shown in German Pat. No. 1,924,862 such a shingle may have prismatically shaped overlapping edges that are wind tight to some extent and, hence, prevent moisture from being driven horizontally under the shingles or panels.

In particular when such panels are made of metal, such as decorative anodized aluminum or thin stainless steel, no insulating function in the usual sense is obtained, but instead they serve mainly to protect the underlying structure from moisture, sun and dissipation of thermal energy by the effect of wind. To this end each panel defines an air-filled compartment that communicates with the outside atmosphere through washboard-type formations that assist in the mounting of such panel but prevent moisture from entering the compartments. Such an arrangement requires extreme care during assembly so that the washboard-type or corrugated attachment portions exactly overlap each other.

In another known arrangement as described in German Pat. No. 2,302,094 the attachment region is formed as grooves and bumps forming an annulus in the plane of the panel so that these grooves and bumps can be juxtaposed in overlapping panels. To this end typically one side, that is a vertical edge, of each panel overlies the corresponding side edge of the panel to one horizontal side and underlies the corresponding side edge of the panel to the other horizontal side. It is also known to provide a particular water run-off groove in such arrangements in order to insure that no water enters behind the panels to the wall.

SUMMARY OF THE INVENTION

It is therefore an object of the present invention to provide an improved wall-covering panel.

Another object is to provide such a panel which can be mounted on a wall shingle-fashion and which not only effectively prevents entry of water underneath the shingles to the wall surface, but which forms an improved vented air compartment behind each single or panel.

These objects are attained according to the present invention in a panel which has a pair of generally parallel side edges extending substantially perpendicularly to a pair of generally parallel end edges, the side edges being vertical when the shingle is in use and the end edges being horizontal. When mounted the shingle has between its end edges a horizontally extending bend which subdivides it generally into an upper half having one of the end edges and a lower half of the other of the end edges, the term "half" here being used in its loosest possible sense, as the bend could subdivide it into a portion constituting a minor part, such as one-quarter, of the total area of the panel and a major part constituting the balance of the area.

In accordance with this invention the panel further has an upper central substantially planar region in the upper half which is surrounded by an upper downwardly U-shaped non-planar attachment portion at the edges of the upper half. A lower central substantially planar region is contiguous with the upper planar region at the band and is generally coplanar therewith in a relaxed unmounted condition of the panel. A lower outwardly directed flange is provided on the lower half at the side and end edges thereof and spacedly surrounds the lower region. A lower upwardly U-shaped contoured non-planar portion has an inner periphery which is connected directly to the lower planar region and an outer periphery connected directly to the flange, so that this lower U-shaped portion lies between the flange and the central planar region of the lower half.

With the system according to the present invention it is therefore possible to cover only a small portion of the complete area of each shingle, while still insuring excellent coverage and protection of the underlying wall. Futhermore it is possible to apply such shingles on either horizontal direction, as the shingles on the same horizontal line do not overlap each other horizontally. Instead each shingle or panel overlies at each of its side edges of its lower half respective side edges of the upper half of two underlying panels. The bottom end edge of each shingle overlies the top end edge of a shingle directly vertically aligned underneath. Considering one face of the panel to be the outer face that is exposed when the unit is mounted, the lower planar region is bent backwardly away from this front or outer face in an unmounted or relaxed condition of the panel so that when mounted each lower half presses firmly against the corresponding portions of the upper halves of the three underlying shingles or panels, tightly holding them in place.

The flange according to this invention lies in the mounted condition of the panel in the same plane as the planar region of the upper section and is flatly engaged with the upper regions of the underlying panels so that the contact area is considerably greater than is normally provided and, therefore, wear of the panels due to thermal expansion and contraction is almost completely eliminated.

The panels according to this invention therefore form generally behind each of the lower planar regions an expansion compartment or a chamber which tapers upwardly and downwardly away from the lower section of the inner periphery of the contoured region. This expansion chamber opens to the atmosphere at a horizontally extending downwardly open slit defined between the lower end edge of the panel and the outer face of the upper planar region of the underlying panel. This slit has a width, therefore, equal to the material thickness forming the panel.

The upwardly open U-shaped contoured region in the lower half of the panel has rounded upper ends that are spaced well below the lowermost portions of the downwardly U-shaped attachment portion. Thus the above-mentioned bend is in reality a relatively wide horizontally extending bend region. In this manner the bend formed in each of the panels during mounting is relatively gentle and horizontal leakage at this bend is entirely ruled out. Furthermore the elastic properties of the material are only moderately stressed so that Hook's limit it not even approached and metal fatigue will not set in.

According to further features of this invention each of the inner and outer peripheries of the upwardly open U-shaped contoured portion of each lower half is formed of two side sections generally parallel to the side edges and an end section generally parallel to the end edges and joining the respective side sections. Each side section of each inner periphery forms with the corresponding side section of the respective outer periphery an angle whose bisector is parallel to the center symmetry line of the panel and, therefore, also parallel to the side edges thereof. Furthermore the apex formed by this angle lies when a plurality of such panels are assembled together in accordance with this invention at the apex of the angle defined between the side and end sections of the outer periphery of the corresponding corner of the overlying panel. Thus each side section of each outer periphery is aligned in a straight line with the side section of the inner periphery of an underlying panel and the side section of the inner periphery of this panel is aligned in a straight line with the side section of the outer periphery of the overlying panel. Such construction creates an attractive decorative appearance, and at the same time insures excellent water run-off and self-cleaning of the panels.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 5:
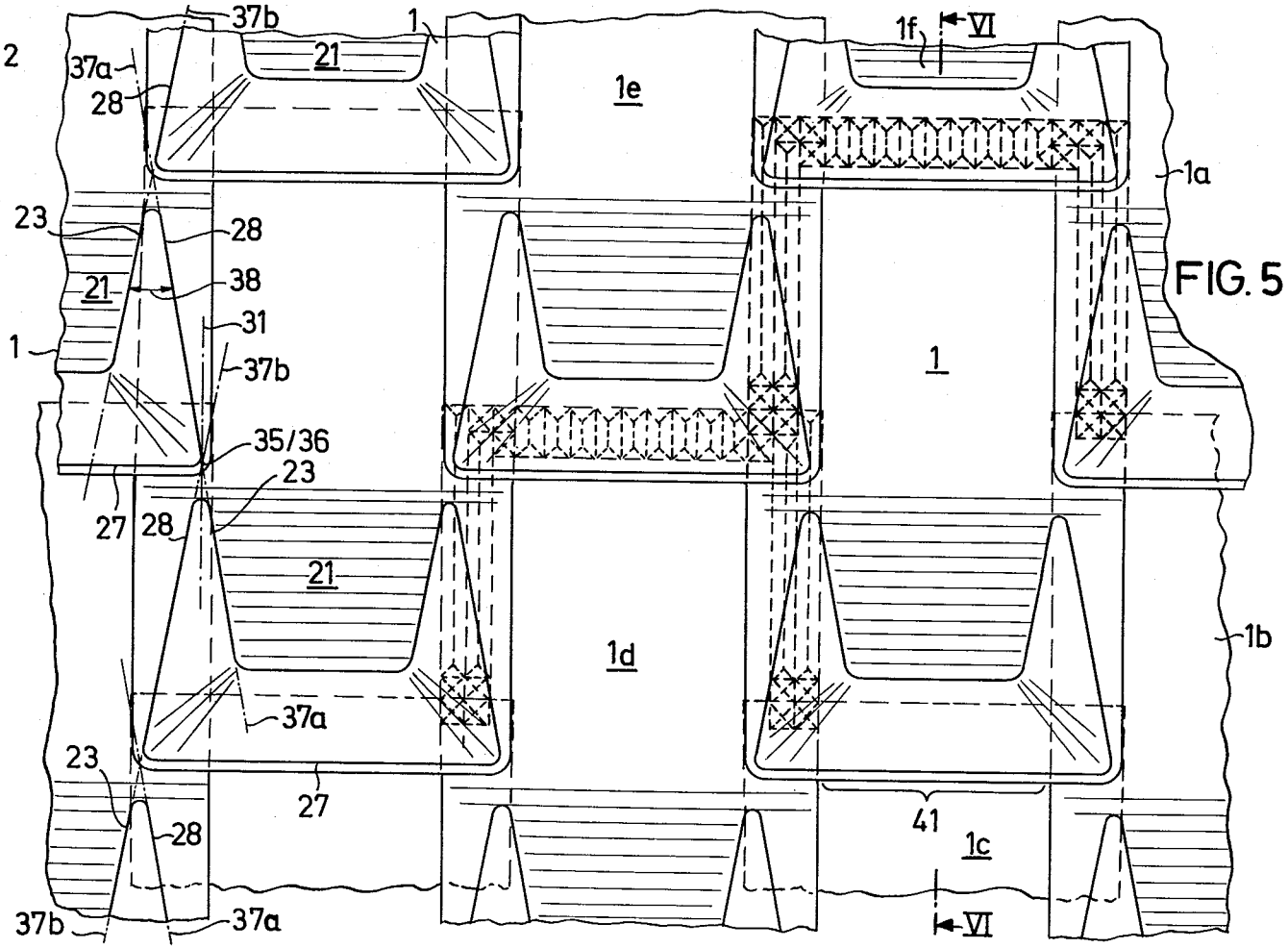
FIG. 5 is a front view showing a plurality of panels according to this invention in mounted condition.
Figure 6:
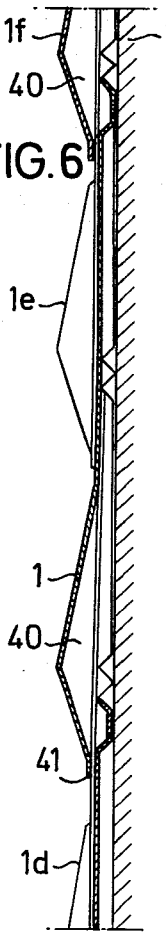
FIG. 6 is a section taken along line VI—VI of FIG. 5.

In accordance with the present invention as seen in FIGS. 1–4 a panel 1 of generally rectangular shape has a pair of parallel side edges 32 and 33 and a pair of parallel end edges 42 and 43. When mounted shingle-fashion to a wall 2 as shown in FIGS. 5 and 6 with a plurality of other such panels 1*a*–1*f* the upper and lower end edges 42 and 43 extend horizontally and the side edges 32 and 33 extend vertically. In addition when mounted the panel 1 has a horizontally extending bend 30 which subdivides it generally into an upper half 10 having the upper end edge 43 and a lower half 20 having the lower end edge 42.

Figure 2:
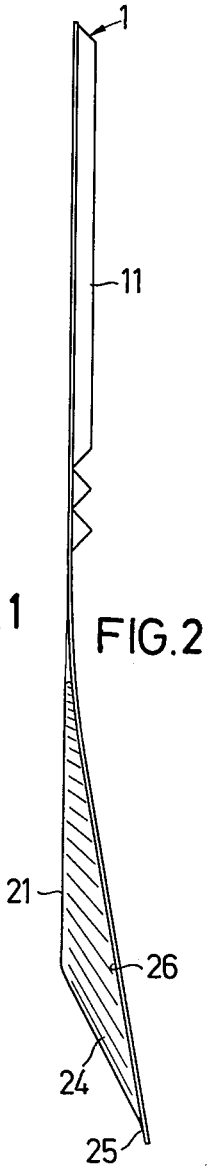
FIGS. 2 and 3 are side and end views respectively taken in the directions of arrows II and III of FIG. 1.
Figure 3:
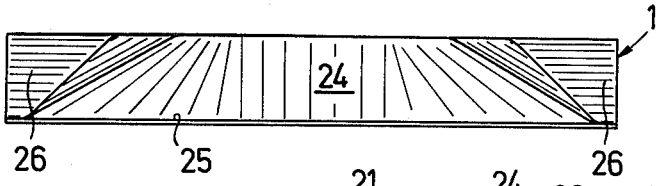
Figure 4:
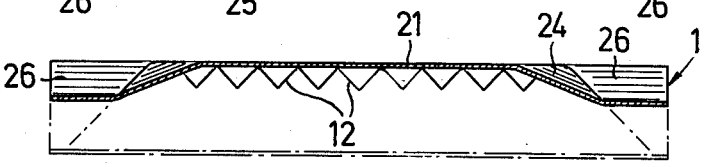
FIG. 4 is a section taken along line IV—IV of FIG. 1.

Further according to this invention the panel has an upper central substantially planar region 44 in the upper half 10 that is surrounded by an upwardly downwardly U-shaped and non-planar attachment portion 11 that lies at the edges 32, 33 and 43 of the upper half. The lower half 20 has a lower central substantially planar region 21 which is contiguous at the bend 30 with the upper region 44 and which as shown in FIG. 2 is generally coplanar with the upper region 44 in a relaxed unmounted condition of the panel 1. Furthermore the lower half has a lower outwardly directed flange comprising an end section 25 at the edge 42 and side section 26 at the edges 32 and 33 which spacedly surrounds the lower planar region 21. Finally the lower half 20 has a lower upwardly U-shaped contoured and non-planar portion 24 that has an inner periphery formed by an end section 22 and side sections 23 that is connected directly to the lower planar region 21 and an outer periphery formed by side sections 28 and an end section 27 that is connected directly to the side sections 26 and end section 25 of the flange 25, 26.

Figure 1:
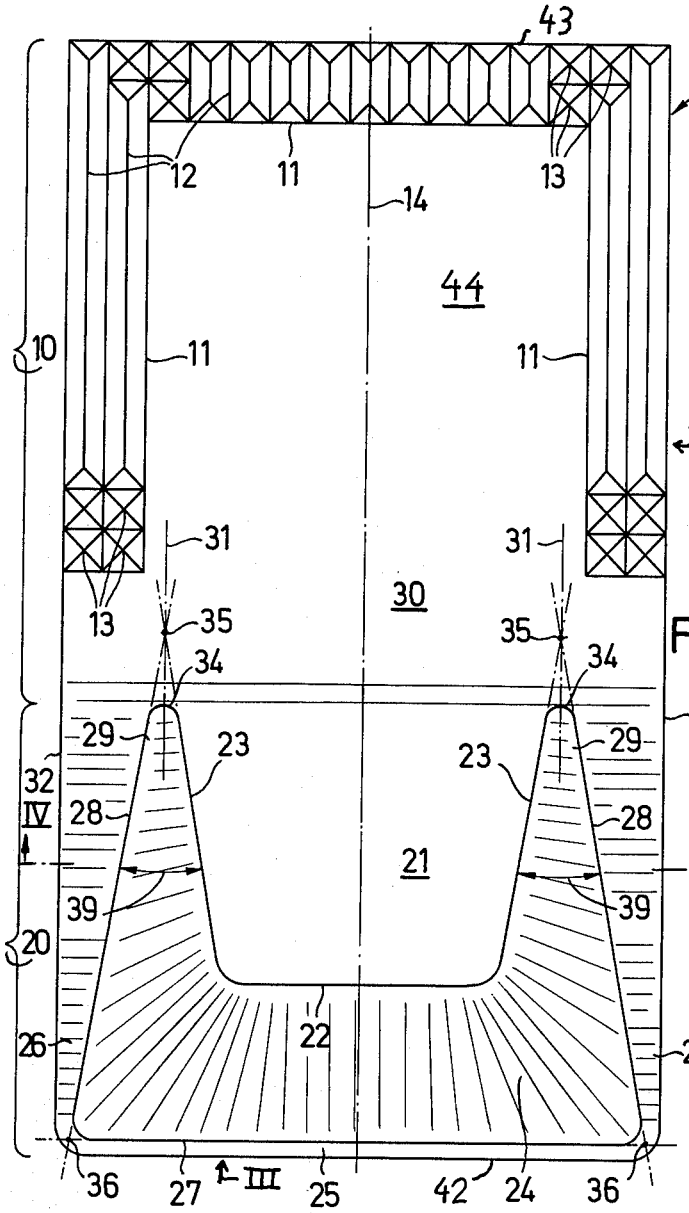
FIG. 1 is a front view of an unmounted panel according to the present invention.

The panel 1 has a vertical central symmetry line 14 parallel to the side edges 32 and 33. Furthermore the contoured portion 24 has upwardly extending legs 29 that are rounded off at 34 so that the region of the bend 30 has a vertical height as seen in FIG. 1 which is equal to between one-twentieth and one-fifth, here approximately one-tenth the overall vertical height of the arrangement which itself is approximately twice the horizontal width thereof.

The downwardly U-shaped attachment portion 11 is formed adjacent the sides 32 and 33 by two vertically extending corrugations 12 and at the bight portion running along the upper edge 43 by nine vertical corregations 12 of identical cross-sectional shape. At the junction between the sides and end portions of the portion 11 three prismatic depressions 13 are formed which have the same cross-section as the corrugations 12 and four such prismatic depressions 13 are formed at the lower ends of the attachment portion 11.

The side sections 23 and 28 of each leg 29 of the contoured portion 24 form an angle 39 whose bisector 31 is parallel to the symmetry line 14 and the side edges 32 and 33. In addition the angle indicated at 39 has an apex 35 which lies at the apex 36 of the angle formed between the end section 27 and each side section 28 when the panels are mounted toether shingle-fashion as illustrated in FIGS. 5 and 6. When thus mounted, with the complete outer face of each lower half 20 of each panel 1-1*f* fully exposed and all three edges of the upper half or mounting portion 10 being covered by respective overlying shingles, each side section 23 of each inner periphery 22, 23 is aligned on a line 37*a* with the side section 28 of the overlying shingle, and each side section 28 lies on a straight line 37*b* with the side section 23 of the underlying shingle. These lines 37*a* and 37*b* cross at the apeces 35 and 36 and form an angle 38.

Furthermore as shown in FIG. 6 each panel 1-1*f* forms an expansion chamber 40 open at a slot 41 to the atmosphere. This slot 41 extends perfectly horizontally and has a width perpendicular to the wall 2 which is approximately equal to the thickness of the sheet material forming the panels. It is noted that these panels can be formed of fiberglass-reinforced synthetic-resin material, or of metal such as anodized aluminum.

The panels are mounted to the wall 2 by riveting, nailing, or screwing in the region 11. It is also possible to adhere them adhesively in the region 11. In no case, however, is the region 10 pierced by any type of attachment.

Rain striking the outer surfaces of the panels when assembled as shown in FIGS. 5 and 6 will run down evenly over them, washing them relatively clean, and flowing in such an even pattern that deposits will not build up in particular places on these panels 1-1*f*. Furthermore the flat steadily and gently increasing inclination in the contoured region 24 eliminates sharp angles on the exposed surface of the panels and further prevents buildup of deposits thereon. The chamber 40 behind each panel widens suddenly as best shown in FIG. 6 above the lower flange 25 which is juxtaposed with the uppermost edge of the planar region 44 so that capiliary action to draw water upwardly into this space is completely countered and even with an extremely powerful and driving wind it is impossible to force water upwardly into the chamber 40 above the underlying panel, so that the wall 2 will always remain perfectly dry. Similarly the relatively narrow width of the gap or slit 41 gives the wind no hold on the under edge of the respective panel and insures that the system will not be loosened, in particular since the panels are prestressed tightly against the side of the building.

It will be understood that each of the elements described above, or two or more together, may also find a useful application in other types of structures differing from the types described above.

While the invention has been illustrated and described as embodied in a wall panel, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims;

1. A panel made of at least limitedly elastically deformable sheet material and adapted to be mounted shingle-fashion with a plurality of other such panels to an upright wall, said panel having a pair of generally parallel side edges and a pair of generally parallel end edges and when mounted having between said end edges a bend subdividing said panel generally into an upper half having one of said end edges and a lower half having the other of said end edges, said panel further having:

an upper central substantially planar region in said upper half, an upper downwardly U-shaped and non-planar attachment portion in said upper half at said edges thereof and surrounding said upper central planar region, a lower central substantially planar region in said lower half contiguous at said bend with said upper planar region and generally coplanar therewith in a relaxed unmounted condition of said panel, a lower outwardly directed flange in said lower half at said edges thereof and spacedly surrounding said lower planar region, and a lower upwardly U-shaped contoured and non-planar portion having an inner periphery connected directly to said lower planar region and an outer periphery connected directly to said flange.

2. The panel defined in claim 1, wherein said inner and outer peripheries of said lower U-shaped portion each have two respective side sections generally parallel to said side edges and one respective end section generally parallel to said other end edge, each of said side sections of said inner periphery extending relative to the respective side section of said outer periphery at an angle whose bisector is substantially parallel to the respective side edge.

3. The panel defined in claim 2, wherein said lower U-shaped portion has a pair of rounded upper ends adjacent said bend.

4. The panel defined in claim 3, wherein said panel is mounted on said wall with a plurality of other such panels and each panel overlies at each of its side edges of its said lower half respective side edges of the upper half of underlying panels, said side sections of said outer periphery of each of said panels defining with the respective end section of said outer periphery a pair of angles having apices lying substantially at the apices of the angles formed by the side sections of the inner and outer peripheries of the underlying panels.

5. The panel defined in claim 4, wherein each side section of the outer periphery of each of said panels is aligned in a straight line with the corresponding side section of the inner periphery of the corresponding underlying panel and each side section of the inner periphery of each of said panels is aligned in a straight line with the corresponding side section of the outer periphery of the corresponding overlying panel.

6. The panel defined in claim 5, wherein said straight lines of each panel define angles equal to the angles between each side section of each inner periphery and the corresponding side section of the respective outer periphery.

7. The panel defined in claim 1, wherein said attachment portion has a pair of side sections each formed with corrugations generally parallel to said side edges and an end section formed with corrugations generally parallel to said side edges.

8. The panel defined in claim 7, wherein each of said side sections has a plurality of bumps in line with respective corrugations.

9. The panel defined in claim 7, wherein said attachment portion is formed between the corrugations of its said side and end sections with bumps spaced in a direction parallel to said side edges.

10. The panel defined in claim 1, wherein said side edges and said end edges are substantially perpendicular.

* * * * *